US011491529B2

(12) United States Patent
Yamauchi

(10) Patent No.: US 11,491,529 B2
(45) Date of Patent: Nov. 8, 2022

(54) FORMING DEVICE

(71) Applicant: SUMITOMO HEAVY INDUSTRIES, LTD., Tokyo (JP)

(72) Inventor: Kei Yamauchi, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 141 days.

(21) Appl. No.: 16/999,996

(22) Filed: Aug. 21, 2020

(65) Prior Publication Data

US 2020/0376536 A1 Dec. 3, 2020

Related U.S. Application Data

(63) Continuation of application No. PCT/JP2018/037754, filed on Oct. 10, 2018.

(30) Foreign Application Priority Data

Feb. 23, 2018 (JP) ..... JP2018-030848

(51) Int. Cl.
*B21D 26/00* (2006.01)
*B21D 26/043* (2011.01)
*B21D 26/045* (2011.01)

(52) U.S. Cl.
CPC ..... *B21D 26/043* (2013.01); *B21D 26/045* (2013.01)

(58) Field of Classification Search
CPC ... B21D 26/043; B21D 26/045; B21D 26/033
See application file for complete search history.

(56) References Cited

U.S. PATENT DOCUMENTS

| | | | |
|---|---|---|---|
| 4,751,836 | A | 6/1988 | Breese |
| 4,951,492 | A | 8/1990 | Vogt |
| 5,233,856 | A | 8/1993 | Shimanovski et al. |
| 5,279,142 | A | 1/1994 | Kaiser |

(Continued)

FOREIGN PATENT DOCUMENTS

| | | | |
|---|---|---|---|
| EP | 1475168 | | 11/2004 |
| JP | H02-084219 | A | 3/1990 |
| JP | 2006-122943 | A | 5/2006 |

(Continued)

OTHER PUBLICATIONS

Search Report issued in European Application No. 18907227.5, dated Feb. 19, 2021.

(Continued)

*Primary Examiner* — Debra M Sullivan
(74) *Attorney, Agent, or Firm* — Michael Best & Friedrich LLP

(57) ABSTRACT

A forming device includes a fluid supply unit that is disposed at an end portion of a metal pipe material and supplies a first fluid to an inside of the metal pipe material via an opening of the end portion, in which the fluid supply unit includes a surrounding portion that surrounds an outer peripheral surface of the end portion and at which an annular groove portion is formed on an inner peripheral surface facing the outer peripheral surface, an annular sealing member disposed in the groove portion, and an operating portion at which a pressurizing force that pressurizes the sealing member toward the outer peripheral surface is generated.

19 Claims, 4 Drawing Sheets

(56) References Cited

U.S. PATENT DOCUMENTS

| | | | | |
|---|---|---|---|---|
| 5,321,964 | A * | 6/1994 | Shimanovski ..... | B21D 26/045 72/62 |
| 10,040,110 | B2 | 8/2018 | Ishizuka et al. | |

FOREIGN PATENT DOCUMENTS

| | | | |
|---|---|---|---|
| JP | 2016-002578 | A | 1/2016 |
| KR | 10-2012-0067148 | A | 6/2012 |
| WO | 9213655 | | 8/1992 |

OTHER PUBLICATIONS

International Search Report issued in Application No. PCT/JP2018/037754, dated Jan. 8, 2019.

* cited by examiner

FORMING DEVICE

RELATED APPLICATIONS

The contents of Japanese Patent Application No. 2018-030848, and of International Patent Application No. PCT/JP2018/037754, on the basis of each of which priority benefits are claimed in an accompanying application data sheet, are in their entirety incorporated herein by reference.

BACKGROUND

Technical Field

A certain embodiment of the present invention relates to a forming device.

Description of Related Art

There is known a forming device in which a metal pipe is formed by supplying a fluid into a heated metal pipe material to expand the metal pipe material. In the case of such a forming device, at the time of supply of the fluid into the metal pipe material, it is necessary to prevent leakage of the fluid by sealing a nozzle for ejection of the fluid and the metal pipe material. For example, in the related art, a forming device is described in which a nozzle having a tapered shape is pushed against an opening of an end portion of a metal pipe material such that the end portion of the metal pipe material is deformed into a funnel shape matching the shape of the nozzle and thus the nozzle and the metal pipe material are sealed.

SUMMARY

According to an embodiment of the present invention, there is provided a forming device including a fluid supply unit that is disposed at an end portion of a metal pipe material and supplies a first fluid to an inside of the metal pipe material via an opening of the end portion, in which the fluid supply unit includes a surrounding portion that surrounds an outer peripheral surface of the end portion and at which an annular groove portion is formed on an inner peripheral surface facing the outer peripheral surface, an annular sealing member disposed in the groove portion, and an operating portion at which a pressurizing force that pressurizes the sealing member toward the outer peripheral surface is generated.

DETAILED DESCRIPTION

Figure 1:
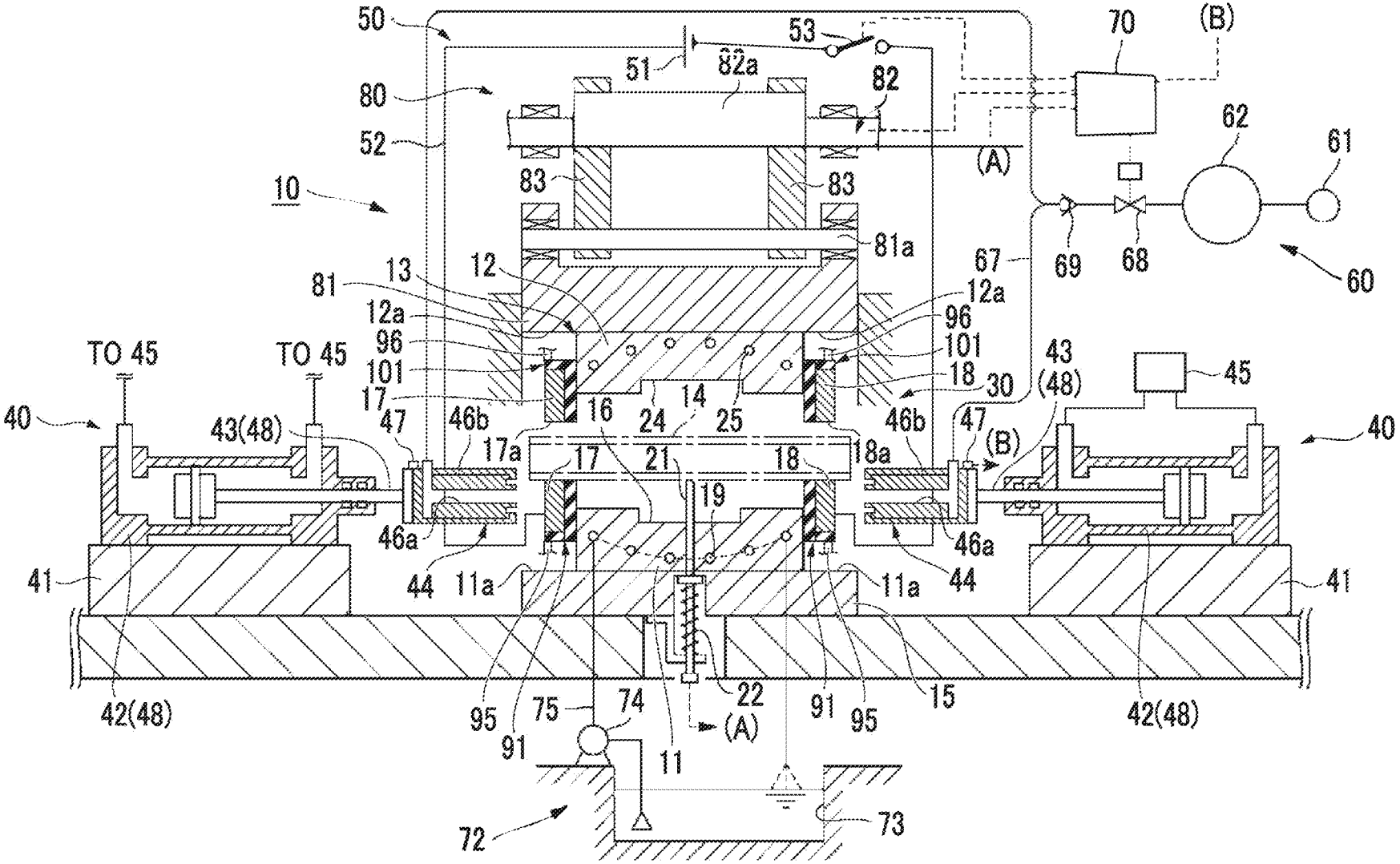
FIG. 1 is a view showing a forming device according to the present embodiment.

In the case of the forming device in the related art, there is a possibility that buckling of the metal pipe material occurs since the nozzle is pushed against the end portion of the metal pipe material with a large pushing force that may cause the end portion of the metal pipe material to be deformed into a shape matching the shape of the nozzle. Meanwhile, for example, in a case where a pushing force of the nozzle against the metal pipe material is reduced to prevent the buckling of the metal pipe material, there is a possibility that the nozzle and the metal pipe material cannot be reliably sealed.

Therefore, it is desirable to provide a forming device with which it is possible to seal a nozzle and a metal pipe material while suppressing buckling of the metal pipe material.

According to the forming device, the sealing member of the fluid supply unit has an annular shape and is disposed in the annular groove portion formed on the inner peripheral surface of the surrounding portion surrounding the outer peripheral surface of the end portion of the metal pipe material. The sealing member is pressurized toward the outer peripheral surface of the metal pipe material due to a pressurizing force generated at the operating portion. Accordingly, the sealing member is pushed against the outer peripheral surface of the end portion of the metal pipe material over the entire circumference such that the fluid supply unit and the metal pipe material are sealed. In addition, at this time, it is not necessary to push the fluid supply unit against the end portion of the metal pipe material with a large pushing force and thus buckling of the metal pipe material is less likely to occur. Therefore, with this device, it is possible to seal a nozzle and the metal pipe material while suppressing buckling of the metal pipe material.

In the forming device according to the embodiment of the present invention, the groove portion may include a first side surface which is a side surface on one side in a direction along a central axis of the inner peripheral surface and a second side surface which is a side surface on the other side, the sealing member may be disposed to come into contact with each of the first side surface and the second side surface and partition a space surrounded by the surrounding portion into an outer peripheral side space which is closer to an outer peripheral side in a radial direction of the inner peripheral surface than the sealing member in the groove portion and an inner peripheral side space which is closer to an inner peripheral side in the radial direction of the inner peripheral surface than the sealing member in the groove portion, and a second fluid may be supplied to the outer peripheral side space through the operating portion. Accordingly, with the second fluid supplied to the outer peripheral side space, a force that acts on the sealing member in a direction toward the inner peripheral side in the radial direction of the inner peripheral surface of the surrounding portion due to the internal pressure of the outer peripheral side space can be made larger than a force that acts on the sealing member in a direction toward the outer peripheral side in the radial direction of the inner peripheral surface of the surrounding portion due to the internal pressure of the inner peripheral side space. Accordingly, with this device, it is possible to generate a pressurizing force that pressurizes the sealing member toward the outer peripheral surface of the end portion of the metal pipe material.

In the forming device according to the embodiment of the present invention, the groove portion may be formed such that an inner peripheral side exposure area, which is an area of exposure of the sealing member with respect to the inner peripheral side space as seen in the radial direction of the inner peripheral surface from the central axis becomes smaller than an outer peripheral side exposure area, which is an area of exposure of the sealing member with respect to the outer peripheral side space as seen in the radial direction of the inner peripheral surface from the central axis. In this case, the groove portion is formed such that the inner peripheral side exposure area by which the internal pressure of the inner peripheral side space is received becomes smaller than the outer peripheral side exposure area by which the internal pressure of the outer peripheral side space is received and thus a force that acts on the sealing member in a direction toward the inner peripheral side in the radial direction of the inner peripheral surface of the surrounding portion due to the internal pressure of the outer peripheral side space can be made larger than a force that acts on the sealing member in a direction toward the outer peripheral side in the radial direction of the inner peripheral surface of the surrounding portion due to the internal pressure of the inner peripheral side space. Accordingly, with this device, it is possible to generate a pressurizing force that pressurizes the sealing member toward the outer peripheral surface of the end portion of the metal pipe material.

In the forming device according to the embodiment of the present invention, at least any of the first side surface and the second side surface may include an inclined portion which is inclined such that a distance between the first side surface and the second side surface in a direction along the central axis decreases toward the inner peripheral side from the outer peripheral side in the radial direction of the inner peripheral surface as seen in a section including the central axis. In this case, the sealing member receives a reaction force acting in a direction toward the outer peripheral side in the radial direction of the inner peripheral surface of the surrounding portion from the inclined portion in a case where the sealing member is moved toward the inner peripheral side in the radial direction of the inner peripheral surface of the surrounding portion while receiving a pressurizing force that pressurizes the sealing member toward the outer peripheral surface. Therefore, with this device, it is possible to more reliably release a seal between the fluid supply unit and the metal pipe material.

In the forming device according to the embodiment of the present invention, the first fluid and the second fluid having the same pressure as each other may be supplied to the fluid supply unit from a common fluid supply source. In this case, the fluid supply unit that supplies the first fluid for expanding the heated metal pipe material also functions as a fluid supply unit that supplies the second fluid for pressurizing the sealing member toward the outer peripheral surface. Therefore, with this device, it is possible to suppress the configuration of the device being complicated since it is not necessary to provide a new fluid supply unit for supply of the second fluid.

In the forming device according to the embodiment of the present invention, a pressure of the second fluid may be higher than a pressure of the first fluid. In this case, the internal pressure of the outer peripheral side space to which the second fluid is supplied is made higher than the internal pressure of the inner peripheral side space to which the first fluid is supplied. Accordingly, with this device, it is possible to more reliably generate a pressurizing force that pressurizes the sealing member toward the outer peripheral surface of the end portion of the metal pipe material.

In the forming device according to the embodiment of the present invention, the first fluid and the second fluid may be supplied to the fluid supply unit from different fluid supply sources. In this case, with this device, it is possible to adjust each of the pressure of the first fluid and the pressure of the second fluid in a suitable manner.

The forming device according to the embodiment of the present invention may further include a pressing force acquisition unit which acquires a pressing force with which the fluid supply unit is pressed in a direction away from the metal pipe material by the first fluid supplied to the inside of the metal pipe material along a direction in which the metal pipe material extends, a forward/rearward movement mechanism which moves the fluid supply unit forward and rearward in the direction in which the metal pipe material extends, and a controller which controls the forward/rearward movement mechanism and the controller may control the forward/rearward movement mechanism such that the fluid supply unit is pushed in a direction toward the metal pipe material with a pushing force corresponding to the pressing force acquired by the pressing force acquisition unit. As the first fluid is supplied to the inside of the metal pipe material, the pressing force with which the fluid supply unit is pressed in the direction away from the metal pipe material by the supplied first fluid is increased. At this time, the pressing force is acquired by the pressing force acquisition unit and with the pushing force corresponding to the acquired pressing force, the fluid supply unit is pushed in the direction toward the metal pipe material by the forward/rearward movement mechanism. Accordingly, movement of the fluid supply unit along the direction in which the metal pipe material extends is suppressed and thus the seal between the fluid supply unit and the metal pipe material can be more reliably maintained in this device.

Hereinafter, an exemplary embodiment will be described with reference to the drawings. In addition, in each drawing, the same reference numerals are assigned to the same or corresponding portions, and repeated descriptions thereof are omitted.

Configuration of Forming Device

Figure 2:
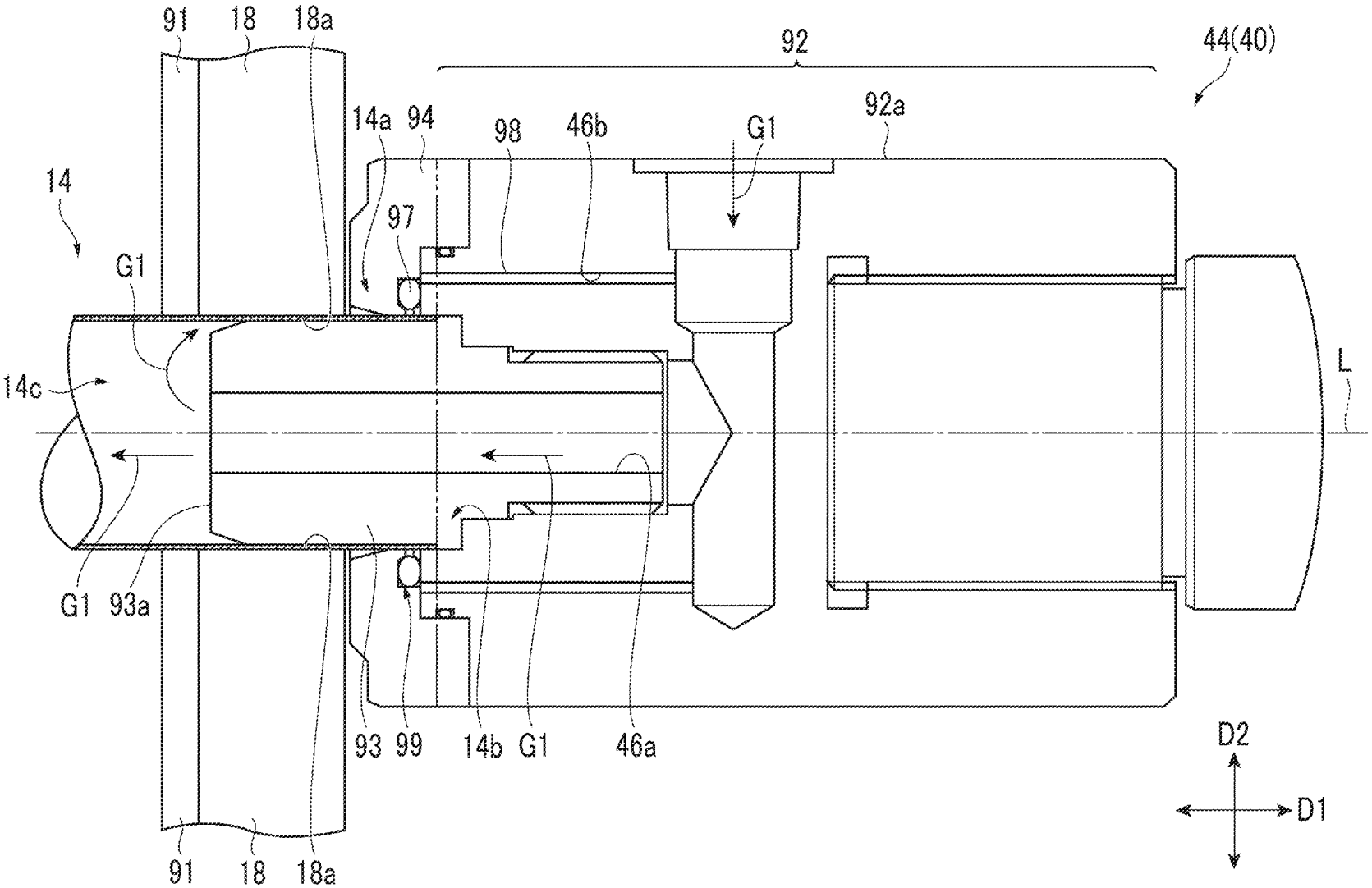
FIG. 2 is a sectional view showing a nozzle disposed at an end portion of a metal pipe material.

FIG. 1 is a view showing a forming device 10 according to the present embodiment. FIG. 2 is a sectional view showing a nozzle 44 disposed at an end portion 14*a* of a metal pipe material 14. As shown in FIGS. 1 and 2, a forming device 10 for forming a metal pipe includes a blow forming die 13 including an upper die 12 and a lower die 11, a drive mechanism 80 which moves at least one of the upper die 12 and the lower die 11, a pipe holding mechanism 30 which holds a metal pipe material 14 disposed between the upper die 12 and the lower die 11, a heating mechanism 50 which energizes the metal pipe material 14 held by the pipe holding mechanism 30 to heat the metal pipe material 14, a gas supply source (fluid supply source) 60 which supplies, to gas supply mechanisms 40, a first high-pressure gas (a first fluid) G1 to be supplied to an inside 14*c* of the metal pipe material 14 via openings 14*b* of the end portions 14*a* of the metal pipe material 14 which is held between the upper die 12 and the lower die 11 and is heated, a pair of the gas supply mechanisms 40 and 40 for supplying the first high-pressure gas G1 from the gas supply source 60 to the inside 14*c* of the metal pipe material 14 held by the pipe holding mechanism 30, a hydraulic oil source 45 which supplies hydraulic oil to the pair of gas supply mechanisms 40 and 40, and a water circulation mechanism 72 which forcibly water-cools the blow forming die 13 and the forming device 10 is configured to include a controller 70 which controls driving of the drive mechanism 80, driving of the pipe holding mechanism 30, hydraulic oil supply of the hydraulic oil source 45, driving of the heating mechanism 50, gas supply of the gas supply source 60, and operation of the pair of gas supply mechanisms 40 and 40. Note that, in FIG. 2, the nozzle 44 included in the gas supply mechanism 40 on the right side in FIG. 1 is shown. The nozzle 44 included in the gas supply mechanism 40 on the left side in FIG. 1 has the same configuration as that in FIG. 2. In addition, the drive mechanism 80 may not move any of the upper die 12 and the lower die 11.

The lower die 11, which is one part of the blow forming die 13, is fixed to a base 15. The lower die 11 is composed of a large steel block and includes a rectangular cavity (a recessed portion) 16 on an upper surface of the lower die 11, for example. A cooling water passage 19 is formed in the lower die 11, and the lower die 11 includes a thermocouple 21 which is inserted from below at a substantially center. The thermocouple 21 measures the temperature of the metal pipe material 14. The thermocouple 21 is supported to be movable upward or downward by a spring 22. The temperature of the metal pipe material 14 may be measured by means of, for example, a non-contact thermometer, temperature estimation performed by using voltage between electrodes, or the like instead of the thermocouple 21 or in addition to the thermocouple 21.

Furthermore, spaces 11*a* are provided near right and left ends (right and left ends in FIG. 1) of the lower die 11 and electrodes 17 and 18 (lower electrodes or like), which are movable portions of the pipe holding mechanism 30 and will be described later, are disposed in the spaces 11*a* to be movable forward or rearward vertically. In addition, the metal pipe material 14 is placed on the lower electrodes 17 and 18 and the lower electrodes 17 and 18 come into contact with the metal pipe material 14 disposed between the upper die 12 and the lower die 11. As a result, the lower electrodes 17 and 18 are electrically connected to the metal pipe material 14.

Insulating materials 91 for preventing energization are provided between the lower die 11 and the lower electrode 17, under the lower electrode 17, between the lower die 11 and the lower electrode 18, and under the lower electrode 18. Each insulating material 91 is fixed to an advancing and retreating rod 95, which is a movable portion of an actuator (not shown) constituting the pipe holding mechanism 30. The actuator is for moving the lower electrodes 17 and 18 or the like upward or downward and a fixed portion of the actuator is held on the base 15 side together with the lower die 11.

The upper die 12, which is the other part of the blow forming die 13, is fixed to a slide 81 (which will be described later) constituting the drive mechanism 80. The upper die 12 is composed of a large steel block, a cooling water passage 25 is formed in the upper die 12, and the upper die 12 includes a rectangular cavity (a recessed portion) 24 on a lower surface of the upper die 12, for example. The cavity 24 is provided at a position facing the cavity 16 of the lower die 11.

As with the lower die 11, spaces 12*a* are provided near right and left ends (right and left ends in FIG. 1) of the upper die 12 and electrodes 17 and 18 (upper electrodes or like), which are movable portions of the pipe holding mechanism 30 and will be described later, are disposed in the spaces 12*a* to be movable forward or rearward vertically. In addition, in a state where the metal pipe material 14 is placed on the lower electrodes 17 and 18, the upper electrodes 17 and 18 move downward come into contact with the metal pipe material 14 disposed between the upper die 12 and the lower die 11. As a result, the upper electrodes 17 and 18 are electrically connected to the metal pipe material 14. Note that, in the present embodiment, both the upper electrodes 17 and 18 and the lower electrodes 17 and 18 are movable forward or rearward vertically as described above. However, only the upper electrodes 17 and 18 may be movable forward or rearward vertically or only the lower electrodes 17 and 18 may be movable forward or rearward vertically.

Insulating materials 101 for preventing energization are provided between the upper die 12 and the upper electrode 17, on the upper electrode 17, between the upper die 12 and the upper electrode 18, and on the upper electrode 18. Each insulating material 101 is fixed to an advancing and retreating rod 96, which is a movable portion of an actuator constituting the pipe holding mechanism 30. The actuator is for moving the upper electrodes 17 and 18 or the like upward or downward and a fixed portion of the actuator is held on the slide 81 side of the drive mechanism 80 together with the upper die 12.

At a right part of the pipe holding mechanism 30, a semi-arc-shaped concave groove 18*a* corresponding to an outer peripheral surface of the metal pipe material 14 is formed on each of surfaces of the electrodes 18 and 18 that face each other and the metal pipe material 14 can be placed so as to be exactly fitted into portions of the concave grooves 18*a*. At the right part of the pipe holding mechanism 30, as with the concave grooves 18*a*, a semi-arc-shaped concave groove corresponding to the outer peripheral surface of the metal pipe material 14 is formed on each of exposed surfaces of the insulating materials 91 and 101 that face each other. Accordingly, if the metal pipe material 14 is clamped from above and below at the right part of the pipe holding mechanism 30, the electrodes 18 can exactly surround the outer periphery of the end portion 14*a* on the right side of the metal pipe material 14 so as to come into close contact with the entire circumference of the right end portion of the metal pipe material 14.

At a left part of the pipe holding mechanism 30, a semi-arc-shaped concave groove 17*a* corresponding to the outer peripheral surface of the metal pipe material 14 is formed on each of surfaces of the electrodes 17 and 17 that face each other and the metal pipe material 14 can be placed so as to be exactly fitted into portions of the concave grooves 17*a*. At the left part of the pipe holding mechanism 30, as with the concave grooves 18*a*, a semi-arc-shaped concave groove corresponding to the outer peripheral surface of the metal pipe material 14 is formed on each of exposed surfaces of the insulating materials 91 and 101 that face each other. Accordingly, if the metal pipe material 14 is clamped from above and below at the left part of the pipe holding mechanism 30, the electrodes 17 can exactly surround the outer periphery of the end portion 14*a* on the left side of the metal pipe material 14 so as to come into close contact with the entire circumference of the left end portion of the metal pipe material 14.

The metal pipe material 14 is placed such that the end portion 14*a* thereof protrudes further than front surfaces (outer surfaces of the dies) of the electrodes 18 in the right part of the pipe holding mechanism 30 when the metal pipe material 14 is clamped at the right part of the pipe holding mechanism 30. The metal pipe material 14 is placed such that the end portion 14*a* thereof protrudes further than front surfaces (outer surfaces of the dies) of the electrodes 17 in the left part of the pipe holding mechanism 30 when the metal pipe material 14 is clamped at the left part of the pipe holding mechanism 30.

The drive mechanism 80 includes the slide 81 which moves the upper die 12 such that the upper die 12 and the lower die 11 are joined to each other, a shaft 82 which generates a driving force for moving the slide 81, and a connecting rod 83 for transmitting the driving force generated by the shaft 82 to the slide 81. The shaft 82 extends in a lateral direction above the slide 81, is supported to be rotatable, and includes an eccentric crank 82*a* which protrudes and extends from right and left ends at a position separated from the center of the shaft 82. The eccentric crank 82*a* and a rotary shaft 81*a* which is provided above the slide 81 and extends in the lateral direction are connected to each other by the connecting rod 83. In the case of the drive mechanism 80, the upward and downward movement (a translational motion) of the slide 81 can be controlled by the controller 70 controlling rotation of the shaft 82 such that the height of the eccentric crank 82*a* in a vertical direction is changed and the positional change of the eccentric crank 82*a* is transmitted to the slide 81 via the connecting rod 83. Here, oscillation (a rotary motion) of the connecting rod 83 generated when the positional change of the eccentric crank 82*a* is transmitted to the slide 81 is absorbed by the rotary shaft 81*a*. The shaft 82 is rotated or stopped in accordance with the driving of a motor or the like controlled by the controller 70, for example. Note that, the drive mechanism 80 is not limited to a mechanism that converts a change in position of the eccentric crank 82*a*, which is caused by rotation of the shaft 82, to a vertical motion of the slide 81 by using the connecting rod 83 and the rotary shaft 81*a* as described above and may be a mechanism that moves the slide 81 upward and downward by using a hydraulic cylinder.

The heating mechanism 50 includes a power supply 51, conducting wires 52 which extend from the power supply 51 and are connected to the electrodes 17 and 18, and a switch 53 which is interposed between the conducting wires 52. The controller 70 can control the heating mechanism 50 such that the metal pipe material 14 is heated to a quenching temperature (equal to or greater than an AC3 transformation point temperature).

Each of the gas supply mechanisms 40 and 40 includes a pressing force acquisition unit 47, a forward/rearward movement mechanism 48, and the nozzle (fluid supply unit) 44 connected to the forward/rearward movement mechanism 48.

The pressing force acquisition unit 47 acquires a pressing force with which the nozzle 44 is pressed in a direction away from the metal pipe material 14 by the first high-pressure gas G1 supplied to the inside 14*c* of the metal pipe material 14 along a direction in which the metal pipe material 14 extends. The pressing force acquisition unit 47 acquires, for example, the pushing-back load with respect to the nozzle 44 as the pressing force. More specifically, the pressing force acquisition unit 47 includes a pressure gauge that measures the pressure value of the first high-pressure gas G1 supplied to the inside 14*c* of the metal pipe material 14 from the nozzle 44 and the pressing force acquisition unit 47 acquires the pressing force based on the measured pressure value. The pressing force acquisition unit 47 outputs information about the acquired pressing force to the controller 70. Note that, the pressing force acquisition unit 47 may acquire a pressure in the inside 14*c* of the metal pipe material 14 as the pressing force. A position at which the pressing force acquisition unit 47 is disposed is not limited to a position as shown in FIG. 1 and the pressing force acquisition unit 47 is disposed at a position such that the pressing force can be favorably acquired in accordance with the configuration of the pressing force acquisition unit 47.

The forward/rearward movement mechanism 48 moves the nozzle 44 forward and rearward in the direction in which the metal pipe material 14 extends. The forward/rearward movement mechanism 48 is controlled by the controller 70. For example, the forward/rearward movement mechanism 48 is controlled by the controller 70 such that the nozzle 44 is pushed in a direction toward the metal pipe material 14 with a pre-set pushing force. The forward/rearward movement mechanism 48 also can push the nozzle 44 in the direction toward the metal pipe material 14 with a pushing force corresponding to the pressing force acquired by the pressing force acquisition unit 47 such that the nozzle 44 does not move along the direction in which the metal pipe material 14 extends. The forward/rearward movement mechanism 48 includes a cylinder unit 42 and a cylinder rod 43 which moves forward and rearward in accordance with an operation of the cylinder unit 42. The cylinder unit 42 is placed on and fixed to a block 41.

The nozzle 44 is disposed at the end portion 14*a* of the metal pipe material 14 and supplies the first high-pressure gas G1 to the inside 14*c* of the metal pipe material 14 via the opening 14*b* of the end portion 14*a* of the metal pipe material 14, the first high-pressure gas G1 being supplied from the gas supply source 60. The nozzle 44 is connected to a tip of the cylinder rod 43 that is on the pipe holding mechanism 30 side.

Figure 3:
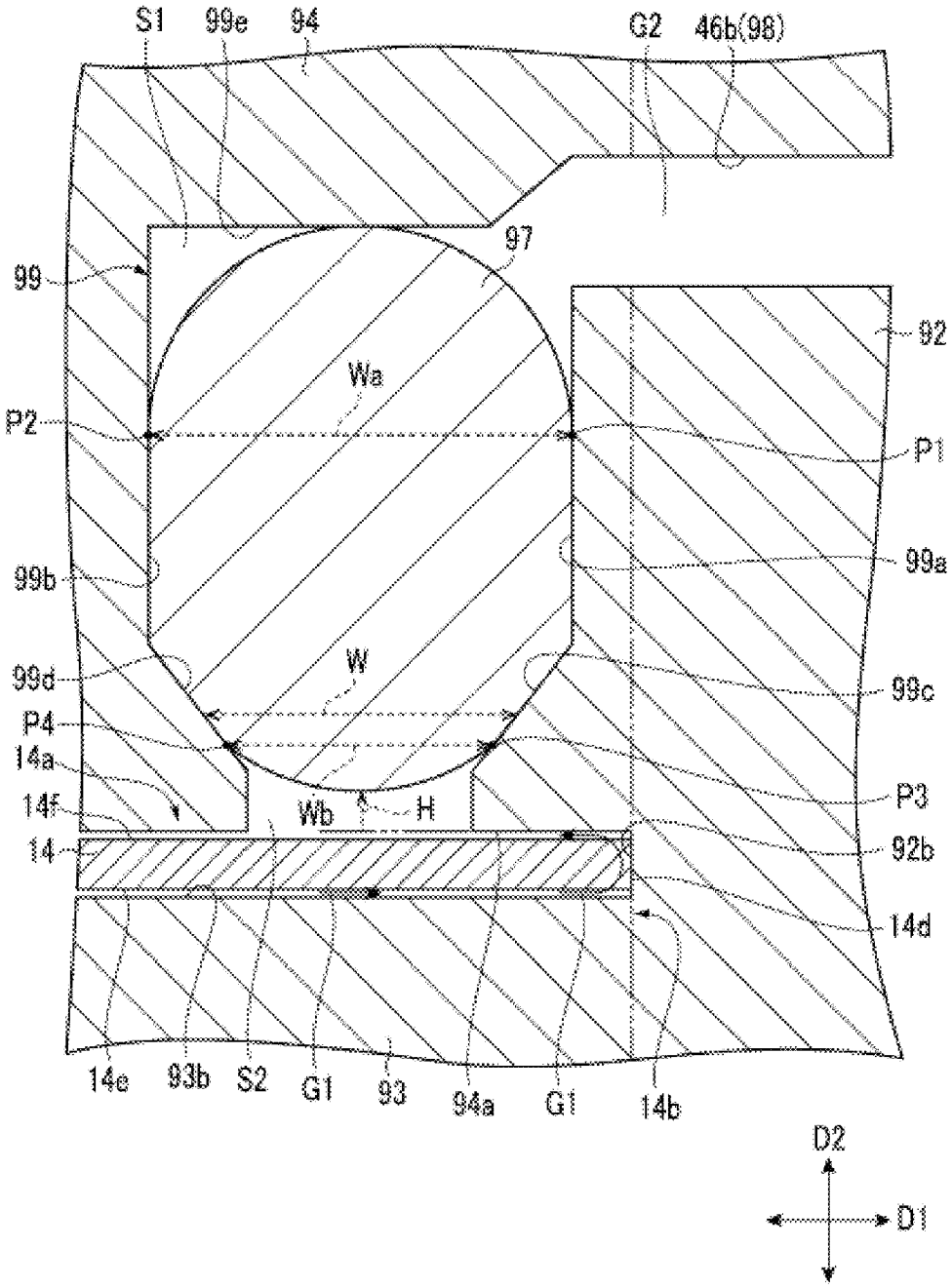
FIG. 3 is a sectional view showing a sealing member in an initial disposition state.
Figure 4:
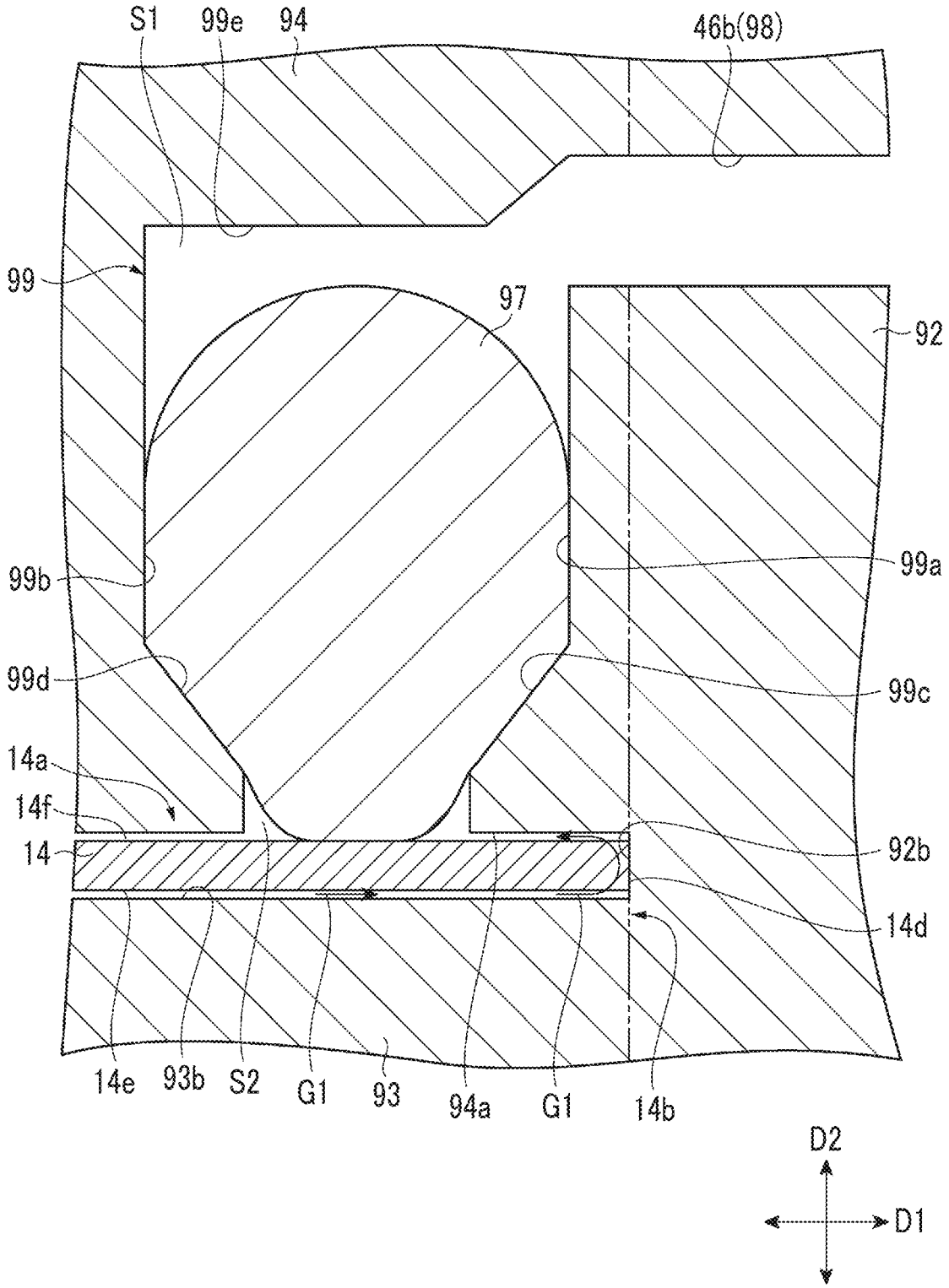
FIG. 4 is a sectional view showing the sealing member in a state where a relative protrusion amount is increased with the sealing member elastically deformed from the initial disposition state.

A specific configuration of the nozzle 44 will be described. FIG. 3 is a sectional view showing a sealing member 97 in an initial disposition state. FIG. 4 is a sectional view showing the sealing member 97 in a state where a relative protrusion amount H is increased with the sealing member 97 elastically deformed from the initial disposition state. FIGS. 3 and 4 show the vicinity of the sealing member 97 on an upper side in FIG. 2. As shown in FIGS. 2 to 4, the nozzle 44 includes a base portion 92, an insertion portion 93, a surrounding portion 94, the sealing member 97, and an operating portion 98. The base portion 92, the insertion portion 93, and the surrounding portion 94 are integrally formed with one member or a plurality of members as a block body. In the present embodiment, a case where the sealing member 97 in the initial disposition state is disposed closer to an outer peripheral side than an inner peripheral surface 94*a* of a groove portion 99 in a radial direction D2 of the inner peripheral surface 94*a* (that is, disposed not to stick out from the groove portion 99) will be described as an example. The "initial disposition state" means a state where the sealing member 97 does not receive a pressurizing force in a direction toward an outer peripheral surface 14*f* of the metal pipe material 14 from the operating portion 98, which will be described later.

The base portion 92 is a portion of the nozzle 44 that is disposed outward of an end surface 14*d* of the end portion 14*a* of the metal pipe material 14. In FIG. 3, the base portion 92 is a portion on the right side of a two-dot chain line shown along the end surface 14*d* of the metal pipe material 14.

The insertion portion 93 is a substantially cylindrical portion provided to stand from a side surface of the base portion 92. The outer diameter of the insertion portion 93 is slightly smaller than the inner diameter of the end portion 14*a* of the metal pipe material 14. Accordingly, the insertion portion 93 can enter and exit the inside 14*c* of the metal pipe material 14 via the opening 14*b* of the end portion 14*a* of the metal pipe material 14 and a first auxiliary seal, which will be described, is realized. Note that, the insertion portion 93 may not have a substantially cylindrical shape and the shape thereof may be another shape (for example, a rectangular tubular shape in which a section perpendicular to a central axis L has a rectangular shape).

In the base portion 92 and the insertion portion 93, a first gas flow path 46*a* through which the first high-pressure gas G1 passes is formed. The first gas flow path 46*a* has openings that are open at an outer surface 92*a* of the base portion 92 and at a tip end surface 93*a* of the insertion portion 93 and is formed such that flow paths extending from the openings are connected to each other in the base portion 92 or in the insertion portion 93. For example, the first gas flow path 46*a* shown in FIG. 2 has a shape in which a flow path that is provided in the base portion 92 to be perpendicular to the outer surface 92*a* of the base portion 92 and a flow path that is provided in the insertion portion 93 to be perpendicular to the tip end surface 93*a* of the insertion portion 93 are connected to each other in the base portion 92. Accordingly, the first high-pressure gas G1 enters the first gas flow path 46*a* via the opening in the outer surface 92*a* of the base portion 92 and is supplied to the inside 14*c* of the metal pipe material 14 via the opening in the tip end surface 93*a* of the insertion portion 93 after proceeding to the first gas flow path 46*a* in the insertion portion 93 from the first gas flow path 46*a* in the base portion 92.

The surrounding portion 94 is formed to surround the outer peripheral surface 14*f* of the end portion 14*a* of the metal pipe material 14. Accordingly, in a case where the end portion 14*a* of the metal pipe material 14 has a cylindrical shape, a section of the inner peripheral surface 94*a* of the surrounding portion 94 facing the outer peripheral surface 14*f* of the end portion 14*a* of the metal pipe material 14 has a circular shape. On the inner peripheral surface 94*a* of the surrounding portion 94, the annular groove portion 99 is formed over the entire circumference of the inner peripheral surface 94*a* to extend around the inner peripheral surface 94*a*.

As seen in a direction (a circumferential direction) along the inner peripheral surface 94*a* of the surrounding portion 94, the groove portion 99 includes a first side surface 99*a* which is a side surface on one side in a direction D1 along the central axis L of the inner peripheral surface 94*a* of the surrounding portion 94 and a second side surface 99*b* which is a side surface on the other side. That is, the second side surface 99*b* is a surface that faces the first side surface 99*a*. Here, the first side surface 99*a* is a side surface on an outer side (a side opposite to a center side in the direction in which the metal pipe material 14 extends) in the direction D1 along the central axis L of the inner peripheral surface 94*a* of the surrounding portion 94 and the second side surface 99*b* is a side surface on an inner side (the center side in the direction in which the metal pipe material 14 extends) in the direction D1 along the central axis L of the inner peripheral surface 94*a* of the surrounding portion 94.

The first side surface 99*a* of the groove portion 99 includes an inclined portion 99*c*. In addition, the second side surface 99*b* of the groove portion 99 includes an inclined portion 99*d*. The inclined portions 99*c* and 99*d* are inclined such that a groove portion width W, which is a distance between the first side surface 99*a* and the second side surface 99*b* in the direction D1 along the central axis L, decreases toward an inner peripheral side from the outer peripheral side in the radial direction D2 of the inner peripheral surface 94*a* as seen in a section including the central axis L of the inner peripheral surface 94*a* of the surrounding portion 94. The inclined portions 99*c* and 99*d* are provided at, for example, positions near the inner peripheral side in the radial direction D2 of the inner peripheral surface 94*a* in the groove portion 99.

The sealing member 97 is an annular member disposed in the groove portion 99 and may be, for example, an O-ring. The sealing member 97 is formed of an elastically deformable material. For example, the sealing member 97 may be formed of fluoro rubber in the viewpoint of the hardness, the heat resistance, and the compression set thereof and particularly may be formed of a viton-based wear resistant material. Alternatively, the sealing member 97 may be formed of nitrile rubber. The sealing member 97 is disposed to come into contact with each of the first side surface 99*a* and the second side surface 99*b* of the groove portion 99. Accordingly, the sealing member 97 partitions a space surrounded by the surrounding portion 94 into an outer peripheral side space S1 which is closer to the outer peripheral side in the radial direction D2 of the inner peripheral surface 94*a* than the sealing member 97 in the groove portion 99 and an inner peripheral side space S2 which is closer to the inner peripheral side in the radial direction D2 of the inner peripheral surface 94*a* than the sealing member 97 in the groove portion 99. The "space surrounded by the surrounding portion 94" means a space including the groove portion 99 and a space that is closer to the inner peripheral side in the radial direction D2 of the inner peripheral surface 94*a* than the inner peripheral surface 94*a*.

Note that, in the following description, the area of exposure of the sealing member 97 with respect to the outer peripheral side space S1 as seen in the radial direction D2 of the inner peripheral surface 94*a* from the central axis L of the inner peripheral surface 94*a* of the surrounding portion 94 will be referred to as an outer peripheral side exposure area and the area of exposure of the sealing member 97 with respect to the inner peripheral side space S2 as seen in the radial direction D2 of the inner peripheral surface 94*a* from the central axis L of the inner peripheral surface 94*a* of the surrounding portion 94 will be referred to as an inner peripheral side exposure area. The groove portion 99 is formed such that the inner peripheral side exposure area becomes smaller than the outer peripheral side exposure area in a case where the sealing member 97 is in the initial disposition state. In this case, the groove portion 99 may be formed such that an inner peripheral side groove portion width Wb becomes smaller than an outer peripheral side groove portion width Wa, which will be described later, in a case where the sealing member 97 is in the initial disposition state.

In other words, the shape of the groove portion 99 is as follows. That is, a distance (that is, the groove portion width W) in the direction D1 along the central axis L between an outermost peripheral side position (a first outer peripheral side position) P1 within a contact portion between the sealing member 97 and the first side surface 99*a* in the radial direction D2 of the inner peripheral surface 94*a* and an outermost peripheral side position (a second outer peripheral side position) P2 within a contact portion between the sealing member 97 and the second side surface 99*b* in the radial direction D2 of the inner peripheral surface 94*a* as seen in a section including the central axis L of the inner peripheral surface 94*a* of the surrounding portion 94 in a case where the sealing member 97 is in the initial disposition state will be referred to as the outer peripheral side groove portion width Wa. In addition, a distance (that is, the groove portion width W) in the direction D1 along the central axis L between an innermost peripheral side position (a first inner peripheral side position) P3 within a contact portion between the sealing member 97 and the first side surface 99*a* in the radial direction D2 of the inner peripheral surface 94*a* and an innermost peripheral side position (a second inner peripheral side position) P4 within a contact portion between the sealing member 97 and the second side surface 99*b* in the radial direction D2 of the inner peripheral surface 94*a* as seen in a section including the central axis L of the inner peripheral surface 94*a* of the surrounding portion 94 in a case where the sealing member 97 is in the initial disposition state will be referred to as the inner peripheral side groove portion width Wb. At this time, the groove portion 99 is formed such that the inner peripheral side groove portion width Wb becomes smaller than the outer peripheral side groove portion width Wa in a case where the sealing member 97 is in the initial disposition state.

In the present embodiment, the sealing member 97 can be increased and decreased in relative protrusion amount H by being elastically deformed. The "relative protrusion amount H" is a height by which the sealing member 97 protrudes to the inner peripheral side in the radial direction D2 of the inner peripheral surface 94*a* from the groove portion 99. More specifically, the relative protrusion amount H is a height by which the sealing member 97 protrudes toward the inner peripheral side further than the inner peripheral surface 94*a* of the surrounding portion 94. The relative protrusion amount His represented by a positive value in a case where the sealing member 97 protrudes to be closer to the inner peripheral side than the inner peripheral surface 94*a* of the surrounding portion 94 and is represented by a negative value in a case where the sealing member 97 does not protrude to be closer to the inner peripheral side than the inner peripheral surface 94*a* of the surrounding portion 94 (that is, in a case where the entire sealing member 97 is inside the groove portion 99) (refer to FIG. 3).

That is, the sealing member 97 can be increased in relative protrusion amount H, by which the sealing member 97 protrudes to the inner peripheral side in the radial direction D2 of the inner peripheral surface 94*a* from the groove portion 99, by being elastically deformed from the initial disposition state in the groove portion 99. In the initial disposition state, the sealing member 97 may protrude (stick out) to the inner peripheral side in the radial direction D2 of the inner peripheral surface 94*a* from the groove portion 99 and may not protrude (not stick out). Note that, in the present embodiment, the sealing member 97 does not abut against the outer peripheral surface 14*f* of the metal pipe material 14 in the initial disposition state. In addition, the sealing member 97 may abut against the outer peripheral surface 14*f* of the metal pipe material 14 when the sealing member 97 is elastically deformed by means of the operating portion 98 and is increased in relative protrusion amount H.

A pressurizing force that pressurizes the sealing member 97 toward the outer peripheral surface 14*f* of the metal pipe material 14 is generated at the operating portion 98. Here, the operating portion 98 causes the sealing member 97 to be elastically deformed from the initial disposition state to increase the relative protrusion amount H of the sealing member 97 such that the sealing member 97 abuts against the outer peripheral surface 14*f* of the metal pipe material 14. For example, through the operating portion 98, a second high-pressure gas (a second fluid) G2 is supplied into the outer peripheral side space S1 such that the product of the internal pressure of the outer peripheral side space S1 and the outer peripheral side exposure area becomes larger than the product of the internal pressure of the inner peripheral side space S2 and the inner peripheral side exposure area. The second high-pressure gas G2 is a gas that is supplied to pressurize the sealing member 97 toward the outer peripheral surface 14*f* of the metal pipe material 14 and here, is a gas supplied to cause the sealing member 97 to elastically deform in the groove portion 99.

The operating portion 98 is, for example, a second gas flow path 46*b* through which the second high-pressure gas G2 is supplied into the outer peripheral side space S1. The second gas flow path 46*b* may be a flow path that branches off from the first gas flow path 46*a* in the base portion 92 and extends up to the outer peripheral side space S1. In this case, the second high-pressure gas G2 flowing through the second gas flow path 46*b* is a gas flowing away from the first high-pressure gas G1 flowing through the first gas flow path 46*a*. Therefore, the first high-pressure gas G1 and the second high-pressure gas G2 are the same as each other in pressure.

For the reasons as follows, the sealing member 97 can be pressurized toward the outer peripheral surface 14*f* (here, more specifically, the sealing member 97 can be elastically deformed from the initial disposition state such that the relative protrusion amount His increased) with the second high-pressure gas G2 supplied to the outer peripheral side space S1 by means of the operating portion 98. That is, a force of which the magnitude corresponds to the product of the internal pressure of the outer peripheral side space S1 and the outer peripheral side exposure area acts on the sealing member 97 in a direction toward the inner peripheral side in the radial direction D2 of the inner peripheral surface 94*a*. Meanwhile, a force of which the magnitude corresponds to the product of the internal pressure of the inner peripheral side space S2 and the inner peripheral side exposure area acts on the sealing member 97 in a direction toward the outer peripheral side in the radial direction D2 of the inner peripheral surface 94*a*. Therefore, the sealing member 97 can be pressurized toward the outer peripheral surface 14*f* (here, the sealing member 97 can be elastically deformed to move to the inner peripheral side in the radial direction D2 of the inner peripheral surface 94*a* such that the relative protrusion amount H is increased) with the second high-pressure gas G2 supplied to the outer peripheral side space S1 by means of the operating portion 98 such that the internal pressure of the outer peripheral side space S1 is increased and thus the product of the internal pressure of the outer peripheral side space S1 and the outer peripheral side exposure area is made larger than the product of the internal pressure of the inner peripheral side space S2 and the inner peripheral side exposure area.

Meanwhile, since the outer diameter of the insertion portion 93 is slightly smaller than the inner diameter of the end portion 14*a* of the metal pipe material 14, the first high-pressure gas G1 supplied to the inside 14*c* of the metal pipe material 14 is less likely to pass through a gap between an outer peripheral surface 93*b* of the insertion portion 93 and an inner peripheral surface 14*e* of the metal pipe material 14. Therefore, leakage of the first high-pressure gas G1 from the inside 14*c* of the metal pipe material 14 is suppressed. That is, a configuration in which the gap between the outer peripheral surface 93*b* of the insertion portion 93 and the inner peripheral surface 14*e* of the metal pipe material 14 is small functions as an auxiliary seal (the first auxiliary seal) between the nozzle 44 and the metal pipe material 14.

In addition, in a case where the nozzle 44 is disposed at the end portion 14*a* of the metal pipe material 14, the end surface 14*d* of the end portion 14*a* of the metal pipe material 14 abuts against a side surface (more specifically, an abutting surface 92*b* interposed between the insertion portion 93 and the surrounding portion 94 in the side surfaces of the base portion 92) of the base portion 92. Accordingly, the first high-pressure gas G1 passing through the first auxiliary seal is less likely to pass through a gap between the end surface 14*d* of the end portion 14*a* of the metal pipe material 14 and the abutting surface 92*b* of the base portion 92. Therefore, leakage of the first high-pressure gas G1 from the inside 14*c* of the metal pipe material 14 is suppressed. That is, a configuration in which the end surface 14*d* of the end portion 14*a* of the metal pipe material 14 abuts against the abutting surface 92*b* of the base portion 92 functions as an auxiliary seal (a second auxiliary seal) between the nozzle 44 and the metal pipe material 14.

The gas supply source 60 includes a gas source 61, an accumulator 62 in which a gas supplied by the gas source 61 is stored, a tube 67 which extends from the accumulator 62 to the first gas flow path 46*a* formed in the nozzle 44, and a pressure control valve 68 and a check valve 69 which are interposed in the tube 67. The check valve 69 plays a role of preventing a high-pressure gas from back-flowing in the tube 67. The pressure control valve 68 interposed in the tube 67 plays a role of supplying the first high-pressure gas G1 of an operation pressure for expanding the metal pipe material 14 to the first gas flow path 46*a* of the nozzle 44 by being controlled by the controller 70.

The hydraulic oil source 45 supplies, to the cylinder unit 42, hydraulic oil of an operation pressure corresponding to a pushing force of the nozzle 44 with respect to the metal pipe material 14. Accordingly, the cylinder unit 42 is operated to move the cylinder rod 43 forward and rearward such that the nozzle 44 moves forward and rearward along the direction in which the metal pipe material 14 extends. Note that, the nozzle 44 may be moved forward and rearward by means of a gas supplied from the gas supply source 60 instead of hydraulic oil supplied from the hydraulic oil source 45. In this case, the gas supply source 60 may further include a tube which extends from the accumulator 62 to the cylinder unit 42 and a pressure control valve and a switching valve which are interposed in the tube and the pressure control valve may supply, to the cylinder unit 42, a gas of an operation pressure corresponding to a pushing force of the nozzle 44 with respect to the metal pipe material 14.

Since the second gas flow path 46*b* is a flow path that branches off from the first gas flow path 46*a* in the base portion 92 and extends up to the outer peripheral side space S1 as described above, the gas supply source 60 supplies both of the first high-pressure gas G1 and the second high-pressure gas G2 to the nozzle 44. In other words, the first high-pressure gas G1 and the second high-pressure gas G2 having the same pressure as each other are supplied to the nozzle 44 from the common gas supply source 60.

The controller 70 can control the pressure control valve 68 of the gas supply source 60 such that the first high-pressure gas G1 of a desired operation pressure is supplied to the inside 14*c* of the metal pipe material 14. In addition, with information transmitted to the controller 70 from (A) shown in FIG. 1, the controller 70 acquires temperature information from the thermocouple 21 and controls the drive mechanism 80, the switch 53, and the like. In addition, with information transmitted to the controller 70 from (B) shown in FIG. 1, the controller 70 acquires information about a pressing force acquired by the pressing force acquisition unit 47 and controls the forward/rearward movement mechanism 48 such that the nozzle 44 is pushed in a direction toward the metal pipe material 14 with a pushing force corresponding to the acquired pressing force. The "pushing force corresponding to the acquired pressing force" is, for example, a pushing force with which the position of the nozzle 44 can be maintained such that the nozzle 44 is not moved in the direction in which the metal pipe material 14 extends by the pressing force and more specifically, is a pushing force of which the magnitude matches the pressing force.

The water circulation mechanism 72 includes a water tank 73 which stores water, a water pump 74 which pumps up the water stored in the water tank 73, pressurizes the water, and sends the water to the cooling water passage 19 of the lower die 11 and the cooling water passage 25 of the upper die 12, and a pipe 75. Although omitted, a cooling tower for lowering a water temperature and a filter for purifying the water may be interposed in the pipe 75.

Forming Method of Metal Pipe Using Forming Device

Next, a forming method of the metal pipe using the forming device 10 will be described with reference to FIGS. 1 to 4. First, the quenchable steel type metal pipe material 14 is prepared. For example, the metal pipe material 14 is placed on (inserted) the electrodes 17 and 18 provided on the lower die 11 side by means of a robot arm or the like. Since the concave grooves 17*a* and 18*a* are formed on the electrodes 17 and 18, the metal pipe material 14 is located by the concave grooves 17*a* and 18*a*.

Next, the controller 70 controls the drive mechanism 80 and the pipe holding mechanism 30 such that the metal pipe material 14 is held by the pipe holding mechanism 30. Specifically, the drive mechanism 80 is driven such that the upper die 12 held on the slide 81 side and the upper electrodes 17 and 18 are moved to the lower die 11 side and the actuator that can move the upper electrodes 17 and 18 and the lower electrodes 17 and 18 included in the pipe holding mechanism 30 forward and rearward is operated such that peripheries of the both end portions of the metal pipe material 14 are clamped from above and below by the pipe holding mechanism 30. The clamping is performed in an aspect in which the concave grooves 17*a* and 18*a* formed on the electrodes 17 and 18 and the concave grooves formed on the insulating materials 91 and 101 are provided such that the electrodes 17 and 18 come into close contact with the vicinity of each of the both end portions of the metal pipe material 14 over the entire circumference.

Note that, at this time, the end portion 14*a* of the metal pipe material 14 that is on the electrode 18 side protrudes toward the nozzle 44 beyond the electrode 18 in the direction in which the metal pipe material 14 extends. Similarly, the end portion 14*a* of the metal pipe material 14 that is on the electrode 17 side protrudes toward the nozzle 44 side beyond the electrode 17 in the direction in which the metal pipe material 14 extends. In addition, lower surfaces of the upper electrodes 17 and 18 and upper surfaces of the lower electrodes 17 and 18 are in contact with each other. However, the present invention is not limited to a configuration in which the electrodes 17 and 18 come into close contact with the entire circumferences of the both end portions of the metal pipe material 14. That is, the electrodes 17 and 18 may abut against a portion of the metal pipe material 14 in a circumferential direction.

Next, the controller 70 controls the heating mechanism 50 so as to heat the metal pipe material 14. Specifically, the controller 70 turns on the switch 53 of the heating mechanism 50. As a result, power transmitted to the lower electrodes 17 and 18 from the power supply 51 is supplied to the upper electrodes 17 and 18 clamping the metal pipe material 14 and the metal pipe material 14 and the metal pipe material 14 generates heat due to Joule heat caused by the resistance of the metal pipe material 14. In addition, the electrodes 17 and 18 are also heated by thermal conduction from the heated metal pipe material 14. Note that, a measurement value of the thermocouple 21 is always monitored, and the energization is controlled based on the result thereof.

Next, the controller 70 controls the drive mechanism 80 such that the blow forming die 13 is closed with respect to the heated metal pipe material 14. Accordingly, the cavity 16 of the lower die 11 and the cavity 24 of the upper die 12 are combined with each other such that the metal pipe material 14 is disposed in a cavity portion between the lower die 11 and the upper die 12 and is sealed.

Thereafter, the cylinder unit 42 of the gas supply mechanism 40 is operated such that each nozzle 44 is moved forward to be disposed at each end portion 14*a* of the metal pipe material 14. Then, the blow forming die 13 is closed and the first high-pressure gas G1 is supplied to the nozzle 44. The first high-pressure gas G1 supplied to the nozzle 44 flows through the first gas flow path 46*a* and is blown into the inside 14*c* of the metal pipe material 14.

Here, since the first gas flow path 46*a* and the second gas flow path 46*b* are connected to each other in the nozzle 44, a portion of the first high-pressure gas G1 flowing through the first gas flow path 46*a* flows away to the second gas flow path 46*b*. The first high-pressure gas G1 flowing away to the second gas flow path 46*b* flows through the second gas flow path 46*b* as the second high-pressure gas G2 and flows into the outer peripheral side space S1 of the groove portion 99. When the second high-pressure gas G2 is supplied to the outer peripheral side space S1, the internal pressure of the outer peripheral side space S1 increases. As a result, a force that acts on the sealing member 97 in a direction toward the inner peripheral side in the radial direction D2 of the inner peripheral surface 94*a* is increased and the force is likely to become larger than a force that acts on the sealing member 97 in a direction toward the outer peripheral side in the radial direction D2 of the inner peripheral surface 94*a*. Moreover, the groove portion 99 is formed such that the inner peripheral side exposure area becomes smaller than the outer peripheral side exposure area. Therefore, the force that acts on the sealing member 97 in the direction toward the inner peripheral side in the radial direction D2 of the inner peripheral surface 94*a* is likely to become larger than the force that acts on the sealing member 97 in the direction toward the outer peripheral side in the radial direction D2 of the inner peripheral surface 94*a*.

When the force that acts on the sealing member 97 in the direction toward the inner peripheral side in the radial direction D2 of the inner peripheral surface 94*a* becomes larger than the force that acts in the direction toward the outer peripheral side, the sealing member 97 is pressurized toward the outer peripheral surface 14*f* of the metal pipe material 14 and is increased in relative protrusion amount H by being elastically deformed from the initial disposition state. Then, the sealing member 97 abuts against the outer peripheral surface 14*f* of the end portion 14*a* of the metal pipe material 14 over the entire circumference such that the nozzle 44 and the metal pipe material 14 are sealed. Note that, at this time, since the sealing member 97 is moved toward the inner peripheral side in the radial direction D2 of the inner peripheral surface 94*a* such that the sealing member 97 is increased in relative protrusion amount H by being elastically deformed from the initial disposition state, the sealing member 97 is in a state of being pushed into a region at which the groove portion width W is small while being on the inclined portions 99*c* and 99*d* of the groove portion 99.

At the same time as when the nozzle 44 and the metal pipe material 14 are sealed in such a manner, the metal pipe material 14 softened by being heated is deformed (formed) to match the shape of the cavity portion due to the internal pressure of the first high-pressure gas G1. The metal pipe material 14 is heated to a high temperature (approximately 950° C.) and thus the first high-pressure gas G1 supplied to the inside 14*c* of the metal pipe material 14 thermally expands. At this time, since the metal pipe material 14 is softened by being heated, the metal pipe material 14 can be easily expanded by compressed air thermally expanded.

At this time, since the internal pressure of the inside 14*c* of the metal pipe material 14 is increased, the nozzle 44 receives the reaction force thereof and is pressed in a direction away from the metal pipe material 14. The pressing force acquisition unit 47 acquires a pressing force that the nozzle 44 receives and outputs information thereof to the controller 70. The controller 70 controls the forward/rearward movement mechanism 48 such that the nozzle 44 is pushed in a direction toward the metal pipe material 14 with a pushing force corresponding to the pressing force based on the information input thereto.

Thereafter, supply of the first high-pressure gas G1 to the inside 14*c* of the metal pipe material 14 is stopped and supply of the second high-pressure gas G2 to the outer peripheral side space S1 of the groove portion 99 is stopped at the same time. As a result, a force that acts on the sealing member 97 in a direction toward the inner peripheral side in the radial direction D2 of the inner peripheral surface 94*a* due to the internal pressure of the outer peripheral side space S1 and a force that acts on the sealing member 97 in a direction toward the outer peripheral side in the radial direction D2 of the inner peripheral surface 94*a* due to the internal pressure of the inner peripheral side space S2 are made equal to each other. Accordingly, the sealing member 97 is decreased in relative protrusion amount and returns to the initial disposition state due to a restoring force with respect to elastic deformation in which the relative protrusion amount thereof is increased from the initial disposition state. Note that, since the sealing member 97 is in a state of being pushed into a region at which the groove portion width W is small while being on the inclined portions 99*c* and 99*d* of the groove portion 99, the sealing member 97 can smoothly and reliably return to the initial disposition state along inclined surfaces of the inclined portions 99*c* and 99*d*.

The outer peripheral surface 14*f* of the blow-formed and expanded metal pipe material 14 comes into contact with the cavity 16 of the lower die 11 so as to be rapidly cooled and comes into contact with the cavity 24 of the upper die 12 so as to be rapidly cooled (the upper die 12 and the lower die 11 have a large heat capacity and are controlled to a low temperature, and thus, if the metal pipe material 14 comes into contact with the upper die 12 and the lower die 11, a heat of a pipe surface is taken to the die side at once) at the same time so that quenching is performed. The above-described cooling method is referred to as die contact cooling or die cooling. Immediately after being rapidly cooled, austenite transforms into martensite (hereinafter, transformation from austenite to martensite is referred to as martensitic transformation). The cooling rate is made low in a second half of the cooling, and thus, martensite transforms into another structure (such as troostite, sorbite, or the like) due to recuperation. Therefore, it is not necessary to separately perform tempering treatment. In addition, in the present embodiment, the cooling may be performed by supplying a cooling medium into, for example, the cavity 24, instead of or in addition to the cooling of the die. For example, cooling may be performed by bring the metal pipe material 14 into contact with the dies (the upper die 12 and the lower die 11) until a temperature at which the martensitic transformation starts is reached and the dies may be opened thereafter with a cooling medium (cooling gas) blown onto the metal pipe material 14 such that martensitic transformation occurs.

A metal pipe having a substantially rectangular main body portion is obtained when cooling is performed and dies are opened after blow forming is performed with respect to the metal pipe material 14 as described above, for example.

Action and Effect of Forming Device

As described above, according to the forming device 10, the sealing member 97 of the nozzle 44 has an annular shape and is disposed in the annular groove portion 99 formed on the inner peripheral surface 94*a* of the surrounding portion 94 surrounding the outer peripheral surface 14*f* of the end portion 14*a* of the metal pipe material 14. The sealing member 97 is pressurized toward the outer peripheral surface 14*f* of the metal pipe material 14 due to a pressurizing force generated at the operating portion 98 and as a result, the sealing member 97 is increased in relative protrusion amount H by being elastically deformed from the initial disposition state. Accordingly, the sealing member 97 abuts against the outer peripheral surface 14*f* of the end portion 14*a* of the metal pipe material 14 over the entire circumference and is pushed against the outer peripheral surface 14*f* such that the nozzle 44 and the metal pipe material 14 are sealed. In addition, at this time, it is not necessary to push the nozzle 44 against the end portion 14*a* of the metal pipe material 14 with a large pushing force and thus buckling of the metal pipe material 14 is less likely to occur. Therefore, with the forming device 10, it is possible to seal the nozzle 44 and the metal pipe material 14 while suppressing buckling of the metal pipe material 14.

In the forming device 10, the groove portion 99 includes the first side surface 99*a* which is a side surface on one side in the direction D1 along the central axis L of the inner peripheral surface 94*a* of the surrounding portion 94 and the second side surface 99*b* which is a side surface on the other side, the sealing member 97 is disposed to come into contact with each of the first side surface 99*a* and the second side surface 99*b* of the groove portion 99 and partitions a space surrounded by the surrounding portion 94 into the outer peripheral side space S1 which is closer to the outer peripheral side in the radial direction D2 of the inner peripheral surface 94*a* than the sealing member 97 in the groove portion and the inner peripheral side space S2 which is closer to the inner peripheral side in the radial direction D2 of the inner peripheral surface 94*a* than the sealing member 97 in the groove portion, and the second high-pressure gas G2 is supplied to the outer peripheral side space S1 through the operating portion 98. Accordingly, with the second high-pressure gas G2 supplied to the outer peripheral side space S1, a force that acts on the sealing member 97 in a direction toward the inner peripheral side in the radial direction D2 of the inner peripheral surface 94*a* due to the internal pressure of the outer peripheral side space S1 can be made larger than a force that acts on the sealing member 97 in a direction toward the outer peripheral side in the radial direction D2 of the inner peripheral surface 94*a* due to the internal pressure of the inner peripheral side space S2. Accordingly, with the forming device 10, it is possible to generate a pressurizing force that pressurizes the sealing member 97 toward the outer peripheral surface 14*f* of the end portion 14*a* of the metal pipe material 14.

Note that, in the forming device 10, the groove portion 99 is formed such that the inner peripheral side exposure area, which is the area of exposure of the sealing member 97 with respect to the inner peripheral side space S2 as seen in the radial direction D2 of the inner peripheral surface 94*a* from the central axis L becomes smaller than the outer peripheral side exposure area, which is the area of exposure of the sealing member 97 with respect to the outer peripheral side space S1 as seen in the radial direction of the inner peripheral surface 94*a* of the surrounding portion 94 from the central axis L. Accordingly, the groove portion is formed such that the inner peripheral side exposure area by which the internal pressure of the inner peripheral side space S2 is received becomes smaller than the outer peripheral side exposure area by which the internal pressure of the outer peripheral side space S1 is received and thus a force that acts on the sealing member 97 in a direction toward the inner peripheral side in the radial direction D2 of the inner peripheral surface 94*a* due to the internal pressure of the outer peripheral side space S1 can be made larger than a force that acts on the sealing member 97 in a direction toward the outer peripheral side in the radial direction D2 of the inner peripheral surface 94*a* due to the internal pressure of the inner peripheral side space S2. Accordingly, with the forming device 10, it is possible to generate a pressurizing force that pressurizes the sealing member 97 toward the outer peripheral surface 14*f* of the end portion 14*a* of the metal pipe material 14.

In the forming device 10, the first side surface 99*a* and the second side surface 99*b* include the inclined portions 99*c* and 99*d* which are inclined such that a distance between the first side surface 99*a* and the second side surface 99*b* in the direction D1 along the central axis L decreases toward the inner peripheral side from the outer peripheral side in the radial direction D2 of the inner peripheral surface 94*a* as seen in a section including the central axis L. Accordingly, the sealing member 97 receives a reaction force acting in a direction toward the outer peripheral side in the radial direction D2 of the inner peripheral surface 94*a* from the inclined portions 99*c* and 99*d* in a case where the sealing member 97 is moved toward the inner peripheral side in the radial direction D2 of the inner peripheral surface 94*a* of the surrounding portion 94 while receiving a pressurizing force that pressurizes the sealing member 97 toward the outer peripheral surface 14*f* of the metal pipe material 14. Therefore, with the forming device 10, it is possible to more reliably release a seal between the nozzle 44 and the metal pipe material 14.

In the forming device 10, the first high-pressure gas G1 and the second high-pressure gas G2 having the same pressure as each other are supplied to the nozzle 44 from the common gas supply source 60. Accordingly, the nozzle 44 that supplies the first high-pressure gas G1 for expanding the heated metal pipe material 14 also functions as the nozzle 44 that supplies the second high-pressure gas G2 for pressurizing the sealing member 97 toward the outer peripheral surface 14*f* of the metal pipe material 14. Therefore, with the forming device 10, it is possible to suppress the configuration of the device being complicated since it is not necessary to provide a new nozzle 44 for supply of the second high-pressure gas G2.

The forming device 10 includes the pressing force acquisition unit 47 which acquires a pressing force with which the nozzle 44 is pressed in a direction away from the metal pipe material 14 by the first high-pressure gas G1 supplied to the inside 14*c* of the metal pipe material 14 along a direction in which the metal pipe material 14 extends, the forward/rearward movement mechanism 48 which moves the nozzle 44 forward and rearward in the direction in which the metal pipe material 14 extends, and the controller 70 which controls the forward/rearward movement mechanism 48 and the controller 70 controls the forward/rearward movement mechanism 48 such that the nozzle 44 is pushed in a direction toward the metal pipe material 14 with a pushing force corresponding to the pressing force acquired by the pressing force acquisition unit 47. As the first high-pressure gas G1 is supplied to the inside 14*c* of the metal pipe material 14, the pressing force with which the nozzle 44 is pressed in the direction away from the metal pipe material 14 by the supplied first high-pressure gas G1 is increased. At this time, the pressing force is acquired by the pressing force acquisition unit 47 and with the pushing force corresponding to the acquired pressing force, the nozzle 44 is pushed in the direction toward the metal pipe material 14 by the forward/rearward movement mechanism 48. Accordingly, movement of the nozzle 44 along the direction in which the metal pipe material 14 extends is suppressed and thus the seal between the nozzle 44 and the metal pipe material 14 can be more reliably maintained in the forming device 10.

The above-described embodiment can be implemented in various forms with various changes and improvements made based on the knowledge of those skilled in the art.

For example, in the initial disposition state, the sealing member 97 may protrude to the inner peripheral side in the radial direction D2 of the inner peripheral surface 94*a* further than the inner peripheral surface 94*a* of the groove portion 99 (that is, the sealing member 97 may stick out from the groove portion 99). In addition, the sealing member 97 may be in contact with the outer peripheral surface 14*f* of the metal pipe material 14 in the initial disposition state.

In addition, the sealing member 97 may not be elastically deformable. For example, the sealing member 97 may have a stiffness such that the sealing member 97 is substantially not deformed by the pressure of the second high-pressure gas G2. Even in this case, the sealing member 97 is pushed against the outer peripheral surface 14*f* of the metal pipe material 14 without being elastically deformed due to the operating portion 98. Therefore, the nozzle 44 and the metal pipe material 14 can be sealed.

In addition, a fluid (the first fluid) that is supplied to the inside 14*c* of the metal pipe material 14 via the opening 14*b* of the end portion 14*a* of the metal pipe material 14 may not be a gas and may be a liquid, for example. Similarly, a fluid (the second fluid) that is supplied to the outer peripheral side space S1 may not be a gas and may be a fluid, for example.

In addition, the shape and position of the second gas flow path 46*b* are not particularly limited. For example, the second gas flow path 46*b* may be formed through only the surrounding portion 94 without being formed through the base portion 92. The second gas flow path 46*b* may be formed along the radial direction D2 from the outer peripheral side space S1 of the groove portion 99 at the outer peripheral side in the radial direction D2 of the surrounding portion 94.

The second gas flow path 46*b* may not branch off from the first gas flow path 46*a*. That is, the second high-pressure gas G2 flowing through the second gas flow path 46*b* may not be a gas flowing away from the first high-pressure gas G1 flowing through the first gas flow path 46*a*. In this case, the forming device 10 may not include a gas supply source that supplies the second high-pressure gas G2 in addition to the gas supply source 60 that supplies the first high-pressure gas G1. In other words, the first high-pressure gas G1 and the second high-pressure gas G2 having the same pressure as each other may not be supplied to the nozzle 44 from the common gas supply source 60.

In addition, the pressure of the second high-pressure gas G2 may be higher than the pressure of the first high-pressure gas G1. In this case, the internal pressure of the outer peripheral side space S1 to which the second high-pressure gas G2 is supplied is made higher than the internal pressure of the inner peripheral side space S2 to which the first high-pressure gas G1 is supplied. Accordingly, with the forming device 10, it is possible to more reliably generate a pressurizing force that pressurizes the sealing member 97 toward the outer peripheral surface 14*f* of the end portion 14*a* of the metal pipe material 14.

In order to realize such a configuration, for example, the forming device 10 may include a gas supply source (fluid supply source) that supplies the second high-pressure gas G2 in addition to the gas supply source 60 that supplies the first high-pressure gas G1. That is, the first high-pressure gas G1 and the second high-pressure gas G2 may be supplied to the nozzle 44 from different gas supply sources (fluid supply sources). In this case, with the forming device 10, it is possible to adjust each of the pressure of the first high-pressure gas G1 and the pressure of the second high-pressure gas G2 in a suitable manner. Alternatively, in the forming device 10, pressure adjustment may be performed such that the pressure of the second high-pressure gas G2 is made higher than the pressure of the first high-pressure gas G1 on a supply line until supply of the first high-pressure gas G1 and the second high-pressure gas G2 to the nozzle 44 from the common gas supply source 60.

In addition, the configuration of the operating portion 98 may be different from that of the second gas flow path 46*b* through which the second high-pressure gas G2 is supplied to the outer peripheral side space S1 as long as the sealing member 97 can be pressurized toward the outer peripheral surface 14*f* of the metal pipe material 14. In this case, the sealing member 97 may not be disposed to be in contact with each of the first side surface 99*a* and the second side surface 99*b* and the groove portion 99 may not be formed such that the inner peripheral side exposure area becomes smaller than the outer peripheral side exposure area.

In addition, in the forming device 10, the second side surface 99*b* of the groove portion 99 may not include the inclined portion 99*d* with the first side surface 99*a* of the groove portion 99 including the inclined portion 99*c*. Alternatively, in the forming device 10, the second side surface 99*b* of the groove portion 99 may include the inclined portion 99*d* with the first side surface 99*a* of the groove portion 99 not including the inclined portion 99*c*. Alternatively, in the forming device 10, the second side surface 99*b* of the groove portion 99 may not include the inclined portion 99*d* with the first side surface 99*a* of the groove portion 99 not including the inclined portion 99*c*.

In addition, the controller 70 may not control the forward/rearward movement mechanism 48 such that the nozzle 44 is pushed in a direction toward the metal pipe material 14 with a pushing force corresponding to the pressing force acquired by the pressing force acquisition unit 47 and in this case, the forming device 10 may not include the pressing force acquisition unit 47.

In addition, the sealing member 97 may be disposed to be in contact with an outer peripheral side inner surface 99*e* on the outer peripheral side in the radial direction D2 of the surrounding portion 94 out of inner surfaces of the groove portion 99 in the initial disposition state (refer to FIG. 3). In this case, the sealing member 97 partitions the outer peripheral side space S1 into a space that is closer to one side in the direction D1 along the central axis L of the inner peripheral surface 94*a* of the surrounding portion 94 than the sealing member 97 and a space that is closer to other side in the direction D1 along the central axis L of the inner peripheral surface 94*a* of the surrounding portion 94 than the sealing member 97. At this time, a communication flow path that connects the one side and the other side of the outer peripheral side space S1 to each other may be formed in the groove portion 99 such that the second high-pressure gas G2 is supplied to both of the one side and the other side of the outer peripheral side space S1 partitioned by the sealing member 97. A communication path may be formed in a groove shape or a through-hole shape at a portion of the outer peripheral side inner surface 99*e* of the groove portion 99, for example.

It should be understood that the invention is not limited to the above-described embodiment, but may be modified in to various forms on the basis of the spirit of the invention. Additionally, the modifications are included in the scope of the invention.

What is claimed is:

1. A forming device comprising:

a fluid supply unit that is disposed at an end portion of a metal pipe material, wherein the fluid supply unit comprises:

a surrounding portion that surrounds an outer peripheral surface of the end portion and at which an annular groove portion is formed on an inner peripheral surface facing the outer peripheral surface, an annular sealing member disposed in the groove portion, and an operating portion at which a pressurizing force that pressurizes the sealing member toward the outer peripheral surface is generated, wherein the fluid supply unit is configured to:

supply a first fluid to an inside of the metal pipe material via an opening of the end portion, and supply a second fluid to an outer peripheral side space through the operating portion, wherein the groove portion comprises:

a first side surface which is a side surface on one side of the groove portion in a direction along a central axis of the inner peripheral surface, and a second side surface which is a side surface on the other side of the groove portion, wherein the sealing member is configured to:

come into contact with each of the first side surface and the second side surface, and partition a space surrounded by the surrounding portion into the outer peripheral side space and an inner peripheral side space, wherein:

the outer peripheral side space is closer to an outer peripheral side in a radial direction of the inner peripheral surface than the sealing member in the groove portion, and the inner peripheral side space is closer to an inner peripheral side in the radial direction of the inner peripheral surface than the sealing member in the groove portion.

2. The forming device according to claim 1, wherein the fluid supply unit further comprises:

a base portion, and an insertion portion that is provided to stand from a side surface of the base portion, and wherein the base portion, the insertion portion, and the surrounding portion are integrally formed as a block body.

3. The forming device according to claim 2, wherein the insertion portion has a substantially cylindrical shape.

4. The forming device according to claim 3, wherein an outer diameter of the insertion portion is smaller than an inner diameter of the end portion of the metal pipe material.

5. The forming device according to claim 4, wherein the insertion portion is configured to:

enter and exit the inside of the metal pipe material via the opening of the end portion of the metal pipe material.

6. The forming device according to claim 2, wherein the insertion portion has a substantially rectangular tubular shape in which a section perpendicular to a central axis of the inner peripheral surface of the surrounding portion has a rectangular shape.

7. The forming device according to claim 2, wherein in the base portion and the insertion portion, a first flow path through which a first fluid passes is formed, and wherein the first flow path comprises:

openings that are open at an outer surface of the base portion and at a tip end surface of the insertion portion and are formed such that flow paths extending from the openings are connected to each other in the base portion or in the insertion portion.

8. The forming device according to claim 2, wherein an abutting surface of the base portion is:

interposed between the insertion portion and the surrounding portion in the side surface of the base portion, and abuts against an end surface of the end portion of the metal pipe material.

9. The forming device according to claim 1, wherein the operating portion is configured to:

cause the sealing member to be elastically deformed from an initial disposition state such that the sealing member abuts against the outer peripheral surface of the metal pipe material.

10. The forming device according to claim 1, wherein the groove portion is formed such that an inner peripheral side exposure area becomes smaller than an outer peripheral side exposure area, wherein:

the inner peripheral side exposure area is an area of exposure of the sealing member with respect to the inner peripheral side space as seen in the radial direction of the inner peripheral surface from the central axis, and the outer peripheral side exposure area, is an area of exposure of the sealing member with respect to the outer peripheral side space as seen in the radial direction of the inner peripheral surface from the central axis.

11. The forming device according to claim 10, wherein the operating portion is configured to:

supply the second fluid to the outer peripheral side space such that a product of an internal pressure of the outer peripheral side space and the outer peripheral side exposure area becomes larger than a product of an internal pressure of the inner peripheral side space and the inner peripheral side exposure area.

12. The forming device according to claim 1, wherein at least any of the first side surface and the second side surface comprises:

an inclined portion which is inclined such that a distance between the first side surface and the second side surface in a direction along the central axis decreases toward the inner peripheral side from the outer peripheral side in the radial direction of the inner peripheral surface as seen in a section including the central axis.

13. The forming device according to claim 1,
wherein the first fluid and the second fluid having the same pressure as each other are supplied to the fluid supply unit.

14. The forming device according to claim 1,
wherein a pressure of the second fluid is higher than a pressure of the first fluid.

15. The forming device according to claim 14,
wherein the first fluid and the second fluid are supplied to the fluid supply unit from different fluid supply sources.

16. A forming device comprising:
a fluid supply unit that is disposed at an end portion of a metal pipe material,
wherein the fluid supply unit comprises:
a surrounding portion that surrounds an outer peripheral surface of the end portion and at which an annular groove portion is formed on an inner peripheral surface facing the outer peripheral surface,
an annular sealing member disposed in the groove portion, and
an operating portion at which a pressurizing force that pressurizes the sealing member toward the outer peripheral surface is generated,
wherein the fluid supply unit is configured to:
supply a first fluid to an inside of the metal pipe material via an opening of the end portion;
a pressing force acquisition unit configured to:
acquire a pressing force with which the fluid supply unit is pressed in a direction away from the metal pipe material by the first fluid supplied to the inside of the metal pipe material along a direction in which the metal pipe material extends;
a forward/rearward movement mechanism configured to:
move the fluid supply unit forward and rearward in the direction in which the metal pipe material extends; and
a controller configured to:
control the forward/rearward movement mechanism, and
control the forward/rearward movement mechanism such that the fluid supply unit is pushed in a direction toward the metal pipe material with a pushing force corresponding to the pressing force acquired by the pressing force acquisition unit.

17. The forming device according to claim 16,
wherein the pressing force acquisition unit acquires a pushing-back load with respect to the fluid supply unit as the pressing force.

18. The forming device according to claim 17,
wherein the pressing force acquisition unit acquires the pressing force based on a pressure value of the first fluid supplied to the inside of the metal pipe material from the fluid supply unit.

19. The forming device according to claim 16,
wherein the forward/rearward movement mechanism comprises:
a cylinder unit, and
a cylinder rod which moves forward and rearward in accordance with an operation of the cylinder unit, and
wherein the fluid supply unit is connected to a tip of the cylinder rod.

* * * * *